US008941575B2

(12) United States Patent
Shen et al.

(10) Patent No.: US 8,941,575 B2
(45) Date of Patent: Jan. 27, 2015

(54) TIMING CONTROLLER FOR DISPLAY

(71) Applicant: Shanghai Tianma Micro-Electronics Co., Ltd., Shanghai (CN)

(72) Inventors: Ling Shen, Shanghai (CN); Yuan Li, Shanghai (CN)

(73) Assignee: Shanghai Tianma Micro-Electronics Co., Ltd., Shanghai (CN)

( * ) Notice: Subject to any disclaimer, the term of this patent is extended or adjusted under 35 U.S.C. 154(b) by 0 days.

(21) Appl. No.: 13/847,934

(22) Filed: Mar. 20, 2013

(65) Prior Publication Data

US 2013/0215002 A1 Aug. 22, 2013

Related U.S. Application Data

(63) Continuation of application No. PCT/CN2011/080019, filed on Sep. 22, 2011.

(51) Int. Cl.
*G09G 3/36* (2006.01)

(52) U.S. Cl.
CPC ..... *G09G 3/3648* (2013.01); *G09G 3/3611* (2013.01); *G09G 2310/08* (2013.01)
USPC ..... 345/99; 345/87; 345/88; 345/89; 345/213; 348/521; 348/564

(58) Field of Classification Search
CPC ..... G09G 5/18; G09G 2310/06; G09G 2310/061; G09G 2310/062; G09G 2310/063; G09G 2310/065; G09G 2310/066; G09G 2310/067
USPC ..... 345/87–89, 204, 98–100, 210–213; 348/446–448, 521–548
See application file for complete search history.

(56) References Cited

U.S. PATENT DOCUMENTS

| | | | | |
|---|---|---|---|---|
| RE37,551 | E * | 2/2002 | Shiki | 345/87 |
| 2002/0080127 | A1 | 6/2002 | Park et al. | |
| 2003/0137528 | A1 * | 7/2003 | Wasserman et al. | 345/700 |
| 2003/0184508 | A1 | 10/2003 | Lee | |
| 2007/0165127 | A1 * | 7/2007 | Minami | 348/308 |
| 2009/0021502 | A1 * | 1/2009 | Lee et al. | 345/205 |
| 2009/0201272 | A1 | 8/2009 | Ahn et al. | |

FOREIGN PATENT DOCUMENTS

| | | | |
|---|---|---|---|
| CN | 1753076 | A | 3/2006 |
| CN | 101859548 | A | 10/2010 |
| JP | 2000-187468 | A | 7/2000 |

* cited by examiner

*Primary Examiner* — Lun-Yi Lao
*Assistant Examiner* — Md Saiful A Siddiqui
(74) *Attorney, Agent, or Firm* — Ardeshir Tabibi, Esq.; Kilpatrick Townsend & Stockton LLP

(57) ABSTRACT

According to one embodiment of the present invention, a timing controller for a display, includes a first unit, a second unit and a third unit. The first unit is configured to generate an image signal from a first input signal. The second unit is configured to generate a multitude of timing signals and a control signal from a multitude of second input signals, the control signal being generated after the multitude of timing signals are generated. The third unit is configured to generate a multitude of first signals from the multitude of timing signals after receipt of the control signal from the second unit. The image signal and the multitude of first signals are configured to drive the display when the timing controller is connected to the display.

15 Claims, 5 Drawing Sheets

--Prior art--

--Prior art--

--Prior art--

TIMING CONTROLLER FOR DISPLAY

CROSS-REFERENCES TO RELATED APPLICATIONS

The present application claims priority to and is a continuation of International Patent Application PCT/CN2011/080019, filed Sep. 22, 2011, entitled "Timing Controller for Display", which claims priority to Chinese Patent Application No. 201110183095.1, filed Jun. 30, 2011 in the People's Republic of China, entitled "Timing Controller for Display", the contents of which are hereby incorporated by reference in their entirety.

BACKGROUND

The present invention relates generally to the field of display control and particularly to a timing controller for a display.

The significant development of multimedia technologies in the modern society is attributable primarily to the progress of semiconductor elements and display devices. In terms of displays, thin film transistor-liquid crystal displays (TFT-LCDs) with a high quality, a high spatial utilization ratio, low power consumption and other advantages have become predominant.

Referring to FIG. 1, a typical TFT-LCD includes an upper substrate 200, a lower substrate 100 and a layer of liquid crystal 400 between the upper substrate 200 and the lower substrate 100, where a color filter layer is typically arranged on the upper substrate 200, the lower substrate 100 is integrated with thin film transistors, and further a polarizing sheet 300 is typically affixed respectively to the outsides of the upper substrate 200 and the lower substrate 100.

Referring to FIG. 2, a lower substrate of a TFT-LCD in the prior art structurally includes a plurality of intersecting scan lines 111 and data lines 121, and an array of pixel elements defined by the plurality of scan lines 111 and data lines 121, where the scan lines 111 are controlled by a scan line drive circuit 110, and the data lines 121 are controlled by a data line drive circuit 120. Particularly each of the pixel elements further includes a pixel electrode 140 and a thin film transistor 130 connected with the pixel electrode 140. A display signal on the data line 121 is transmitted to the pixel electrode 140 when the thin film transistor 130 is turned on, and the thin film transistor 130 is controlled by the scan line 111 to be turned on or turned off.

The foregoing TFT-LCD is typically driven by a timing controller (T-CON) chip at present in the industry. FIG. 3 illustrates the structure of a typical T-CON chip in the prior art. Referring to FIG. 3, the T-CON chip 1 typically includes an RGB data processing unit 11 and a timing controlling unit 12. The RGB data processing unit 11 is generally configured to perform, for example, a dithering process and vertical rate control on RGB input data to obtain RGB output data (RGB here refers to the RGB domain) to thereby achieve a better image display effect. The timing controlling unit 12 is primarily configured to convert input control signals input to the T-CON chip 1, such as for example, a clock signal (DCLK), a horizontal synchronization signal (HS), a vertical synchronization signal (VS), a data enabling signal (DE), and so on, into a source control signal and a gate control signal to drive the TFT-LCD.

However, strict timing constraint conditions imposed on the input control signals for the existing T-CON chip greatly limit the compatibility or applicability of the T-CON chip with certain TFT-LCDs. In general, a T-CON chip is compatible with only a limited number of TFT-LCDs with different resolutions. Internal settings in the T-CON chip must be modified or a different type of T-CON chip must be used to support another resolution. Even for TFT-LCDs with the same resolution, different T-CON chip manufactures also impose different timing constraint conditions on the input control signals. This situation also limits the universality of a T-CON chip.

BRIEF SUMMARY

A problem to be addressed by the embodiments of the invention is to provide a timing controller for a display so as to improve compatibility to displays.

According to one embodiment of the present invention, a timing controller for a display, includes a first unit, a second unit and a third unit. The first unit is configured to generate an image signal from a first input signal. The second unit is configured to generate a multitude of timing signals and a control signal from a multitude of second input signals, the control signal being generated after the multitude of timing signals are generated. The third unit is configured to generate a multitude of first signals from the multitude of timing signals after receipt of the control signal from the second unit. The image signal and the multitude of first signals are configured to drive the display when the timing controller is connected to the display.

According to one embodiment of the present invention, a method for controlling timing signals to a display by a timing controller is disclosed. The method includes generating an image signal from a first input signal, generating a multitude of timing signals from a multitude of second input signals and generating a control signal from the multitude of second input signals after the multitude of timing signals are generated. The method further includes generating a multitude of first signals from the multitude of timing signals after receipt of the control signal and driving the display by the timing controller when the image signal and the multitude of first signals are connected to the display.

A better understanding of the nature and advantages of the embodiments of the present invention may be gained with reference to the following detailed description and the accompanying drawings.

DETAILED DESCRIPTION

The timing controller according to one embodiment of the present invention detects and obtains a multitude of key timing parameters from a multitude of input control signals, and the timing controlling unit generates a multitude of timing control signals based upon the multitude of key timing parameters instead of the input control signals Correspondingly, the multitude of input control signals required for the timing controlling unit to generate the multitude of timing control signals, satisfies a basic relationship between vertical timing and horizontal timing in an image, which is a default timing constraint condition for the majority of displays. Thus the timing controller simplifies the timing constraint on generating the timing control signals and improves the compatibility of the timing controller to various displays.

Figure 1:
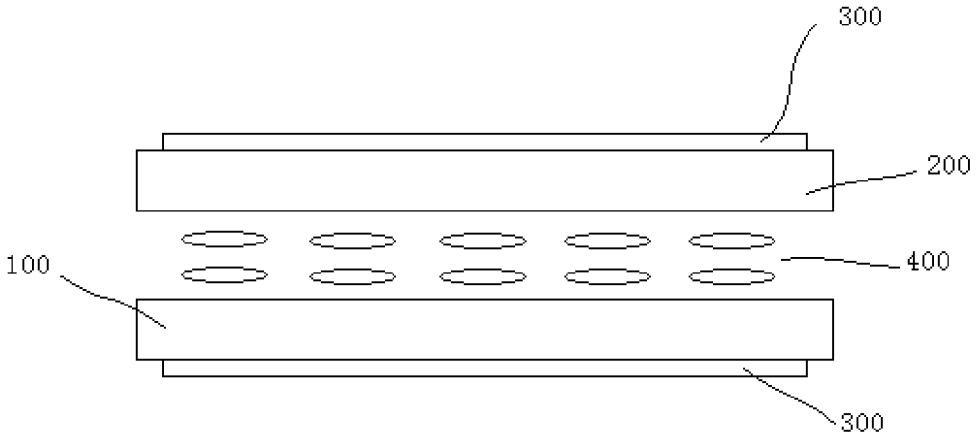
FIG. 1 is a simplified schematic block diagram of a typical TFT-LCD in the prior art.
Figure 2:
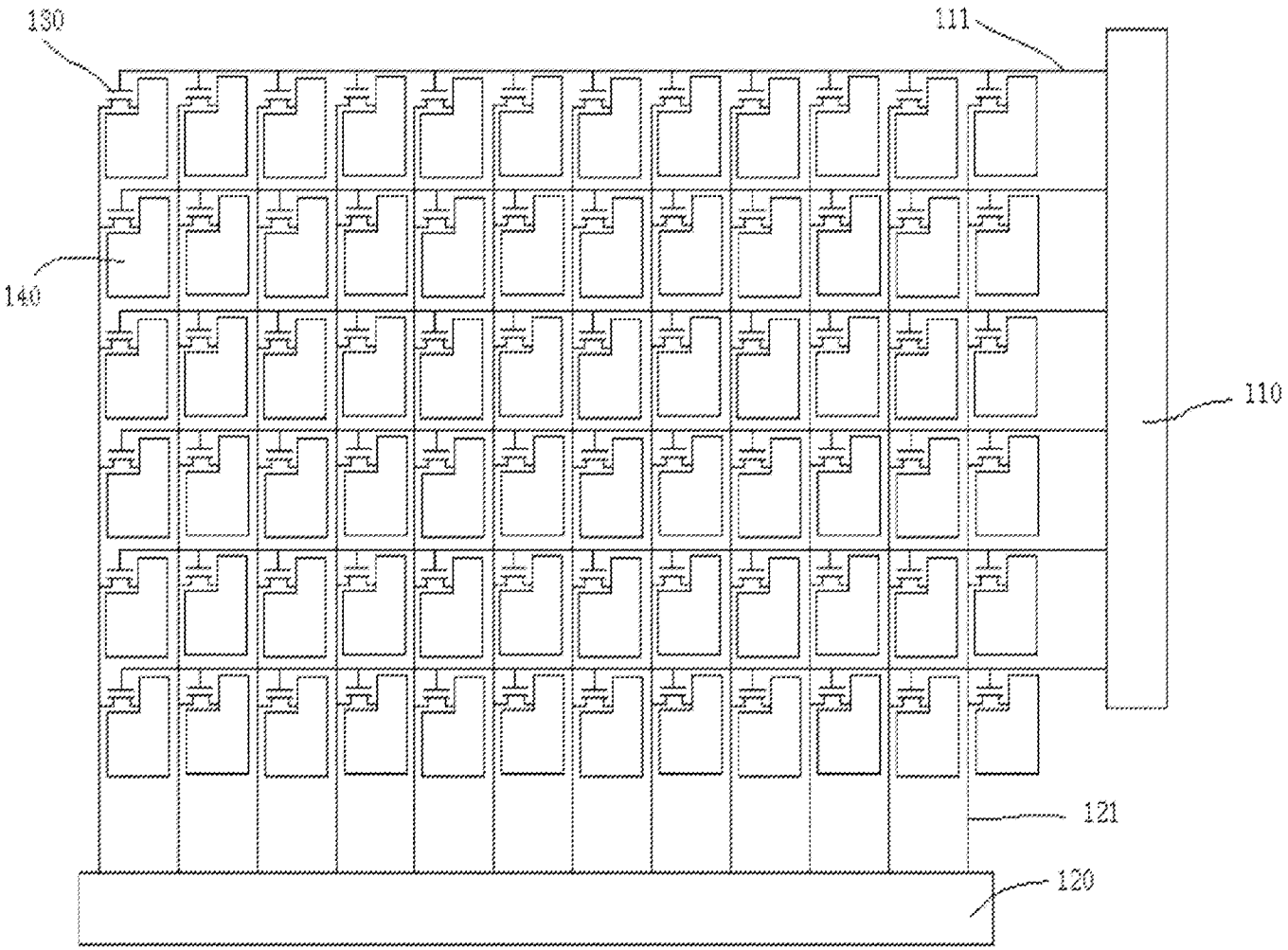
FIG. 2 is a simplified schematic block diagram of a lower substrate of the TFT-LCD in the prior art.
Figure 3:
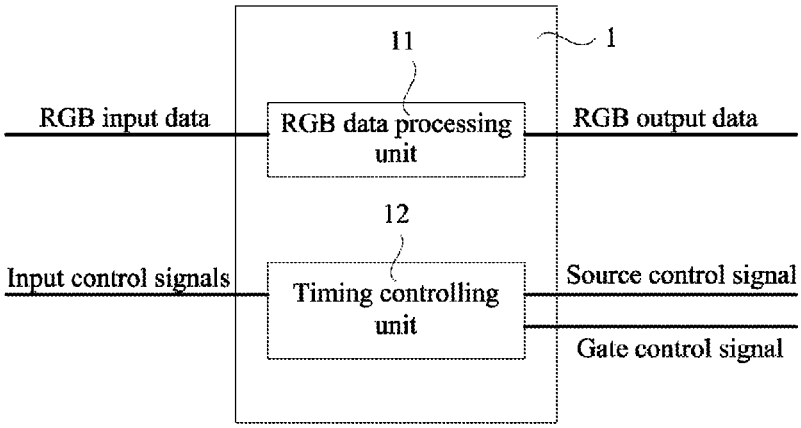
FIG. 3 is a simplified schematic block diagram of a typical T-CON chip in the prior art.
Figure 4:
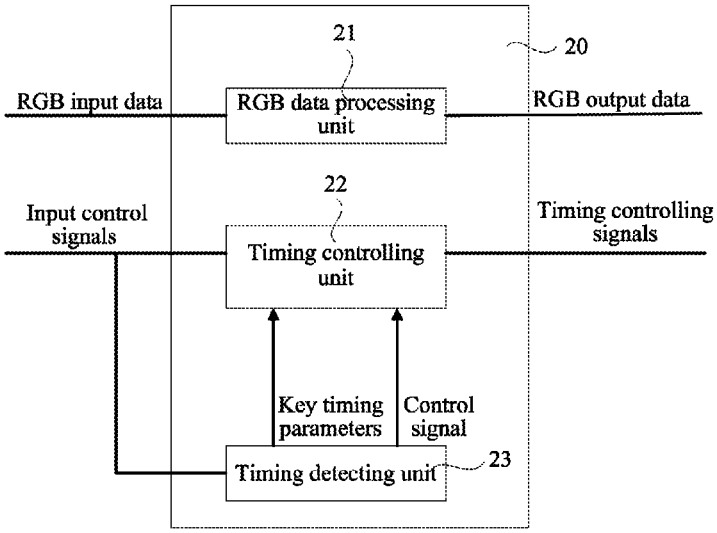
FIG. 4 is a simplified schematic block diagram of a timing controller for a display in accordance with a first embodiment of the present invention.

FIG. 4 is a simplified schematic block diagram of a timing controller 20 for a display in accordance with a first embodiment of the present invention. Timing controller 20 includes an RGB data processing unit 21, a timing controlling unit 22 and a timing detecting unit 23. RGB data processing unit 21 is configured to perform image optimization processing on RGB input data and to output RGB output data. Timing controlling unit 22 is configured to generate timing control signals responsive to input control signals received by timing controller 20. After being started, timing controlling unit 22 generates the timing control signals responsive to the received input control signals after obtaining key timing parameters generated by timing detecting unit 23. Timing detecting unit 23 is configured to detect and obtain from the input control signals the key timing parameters required for generating the timing control signals and to generate a control signal to start timing controlling unit 22 upon detecting the key timing parameters.

In the foregoing embodiment, a primary input source required for timing controlling unit 22 to generate the timing control signals, which is different from the input control signals in the prior art, is the key timing parameters. It is only necessary for the input control signals to satisfy a basic relationship between vertical timing and horizontal timing in an image, that is, the period of a vertical synchronization interval is larger than a horizontal synchronization cycle, which in turn is larger than a horizontal synchronization interval. The basic relationship between vertical timing and horizontal timing is a default timing constraint condition for the majority of displays. Thus, it is not necessary for the timing controller in the foregoing embodiment to satisfy any other timing constraint condition than those default timing constraint conditions for the displays, thereby improving the timing controller's compatibility with various displays. An embodiment of a timing controller for a thin film transistor-liquid crystal display will be described below as an example.

Figure 5:
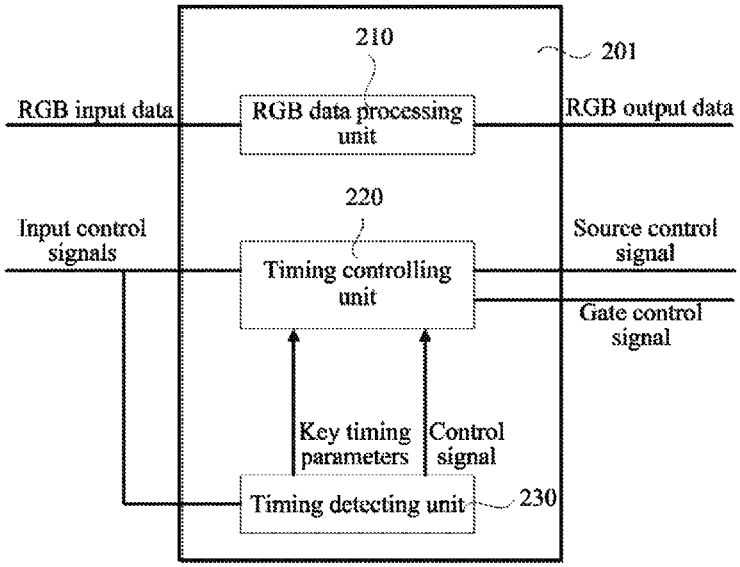
FIG. 5 is a simplified schematic block diagram of a timing controller for a display in accordance with a second embodiment of the present invention.

FIG. 5 is a simplified schematic block diagram of a timing controller 201 for a display in accordance with a second embodiment of the present invention, which illustrates a timing controller for a thin film transistor-liquid crystal display. Timing controller 201 includes an RGB data processing unit 210, a timing controlling unit 220 and a timing detecting unit 230. RGB data processing unit 210 is configured to perform image optimization processing on RGB input data and to output RGB output data. Timing controlling unit 220 is configured at least to generate a source control signal and a gate control signal responsive to a input control signal received by timing controller 201. After being started, timing controlling unit 220 generates the source control signal and the gate control signal after obtaining key timing parameters generated by timing detecting unit 230. Timing detecting unit 230 is configured to detect and obtain from an input control signal the key timing parameters required for generating the source control signal and the gate control signal and to generate a control signal to start timing controlling unit 220 upon detecting the key timing parameters.

Figure 6:
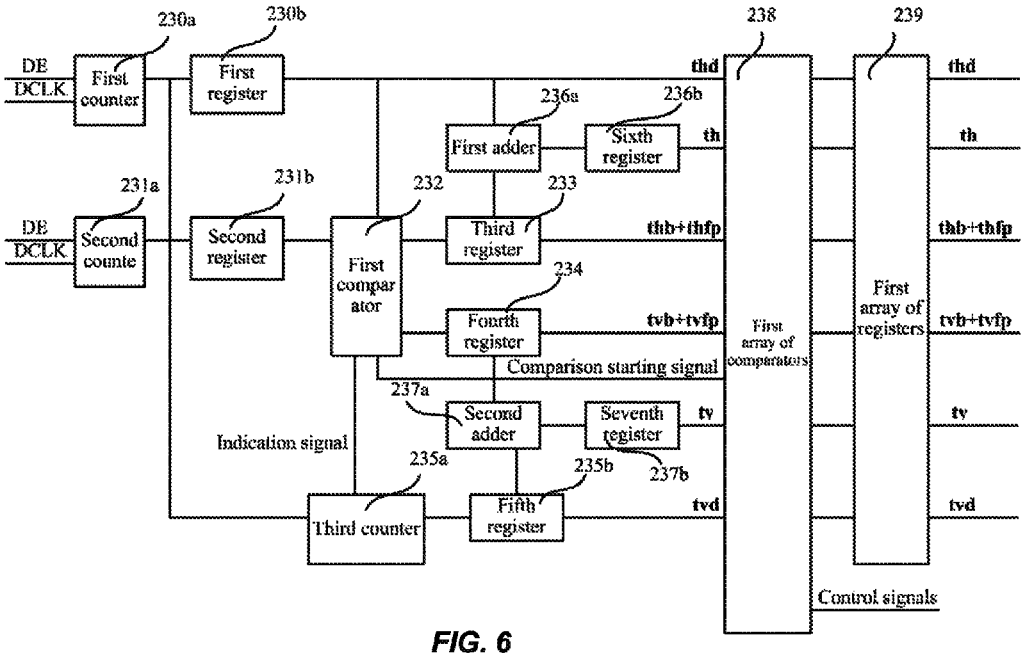
FIG. 6 is a schematic block diagram of a timing detecting unit in the timing controller illustrated in FIG. 5, in accordance with an embodiment of the present invention.

FIG. 6 is a schematic block diagram of timing detecting unit 230 in the timing controller illustrated in FIG. 5, in accordance with an embodiment of the present invention for a thin film transistor-liquid crystal display. Referring to FIG. 6, the timing detecting unit includes: a first counter 230*a* and a first register 230*b*; a second counter 231*a* and a second register 231*b*; a first comparator 232; a third register 233; a fourth register 234; a third counter 235*a* and a fifth register 235*b*; a first adder 236*a* and a sixth register 236*b*; a second adder 237*a* and a seventh register 237*b*; a first array of comparators 238; and a first array of registers 239.

Inputs of both first counter 230*a* and second counter 231*a* receive a data enabling signal DE and a clock signal DCLK. Inputs of first register 230*b* and second register 231*b* are connected with outputs of first counter 230*a* and second counter 231*a*, respectively. Inputs of first comparator 232 are connected respectively with outputs of first register 230*b* and second register 231*b*. Outputs of first comparator 232 are connected respectively with an input of third register 233, an input of fourth register 234, an input of third counter 235*a* and a control signal for first array of comparators 238.

Outputs of third register 233 and fourth register 234 are connected with data inputs of first array of comparators 238. An input of the third counter 235*a* is further connected with the output of first counter 230*a*, and an input of fifth register 235*b* is connected with an output of third counter 235*a*. Inputs of first adder 236*a* are connected respectively with an output of first register 230*b* and an output of third register 233, and an input of sixth register 236*b* is connected with an output of first adder 236*a*. Inputs of second adder 237*a* are connected respectively with an output of fifth register 235*b* and an output of fourth register 234, and an input of seventh register 237*b* is connected with an output of second adder 237*a*.

Data inputs of first array of comparators 238 are further connected with outputs of first register 230*b*, sixth register 236*b*, seventh register 237*b* and fifth register 235*b*. First array of comparators 238 has data outputs connected with data inputs of first array of registers 239 and a control output connected with the timing controlling unit, configured to output the control signals to the timing controlling unit. Data outputs of first array of registers 239 are configured to output the key timing parameters to the timing controlling unit.

A process for the timing detecting unit to detect and obtain a horizontal display period thd, a horizontal synchronization cycle th, a horizontal synchronization interval thb+thfp, a vertical display period tvd, a vertical synchronization cycle tv and a vertical synchronization interval tvb+tvfp and a process of controlling the timing controlling unit to generate the source control signal and the gate control signal will be described below.

Figure 7:
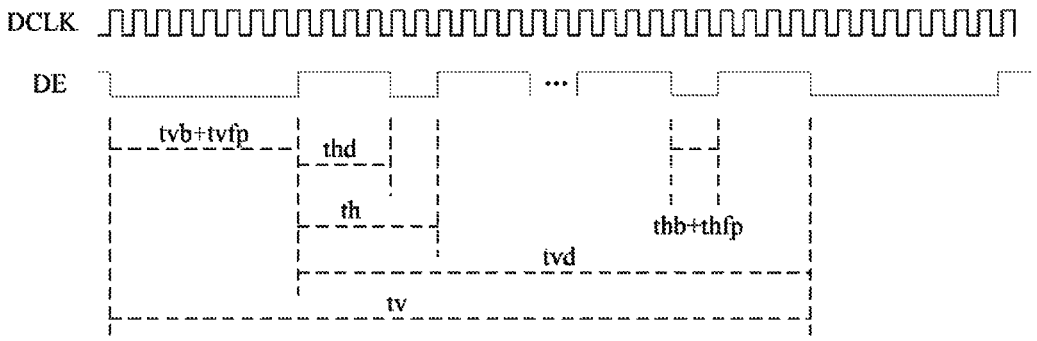
FIG. 7 is a timing relationship diagram for key timing parameters in the timing detecting unit illustrated in FIG. 6, in accordance with an embodiment of the present invention.

FIG. 7 is a timing relationship diagram for the foregoing six key timing parameters in the timing detecting unit illustrated in FIG. 6, in accordance with an embodiment of the present invention. The definitions of the foregoing six key timing parameters and their mutual timing relationships will be described below.

Detection of the vertical synchronization interval tvb+tvfp indicates the start of an image frame, and the next detection of the vertical synchronization interval tvb+tvfp indicates the end of the image frame. Similarly, detection of the horizontal synchronization interval thb+thfp indicates the start of a line in an image frame, and the next detection of the horizontal synchronization interval thb+thfp indicates the end of the line in the image frame.

The timing relationships between the foregoing six key timing parameters are defined as:

$$th=thd+thb+thfp \quad (1),$$

and $$tv=tvd+tvb+tvfp \quad (2).$$

In this embodiment, the timing controlling unit imposes only one constraint condition on the input control signal, that is, (tvb+tvfp)>th>(thb+thfp), and an analysis of this constraint condition indicates that the period of the vertical synchronization interval is larger than the horizontal synchronization cycle, which in turn is larger than the horizontal synchronization interval. As can be apparent from the definitions of the respective parameters in the constraint condition and their mutual relationships, the constraint condition represents a logic relationship which is a default condition for all the TFT-LCDs to ensure general display. Thus, it is not necessary to satisfy any other timing constraint condition than those default timing constraint conditions for the TFT-LCDs. Accordingly, the timing controller of this embodiment can be applicable to all the TFT-LCDs with different resolutions.

Referring to FIG. 6 and FIG. 7 together, when the data enabling signal DE is at a high level, it indicates the starting of a new line in an image frame, and at this time first counter 230*a* starts counting based upon the clock signal DCLK. When the data enabling signal DE is at a low level, first counter 230*a* stops counting and stores a counted value into first register 230*b*, which is then reset to zero. At this time, the value in the first register 230*b* represents the horizontal display period thd, and the value in the first register 230*b* is particularly the number of times that the high level of the clock signal DCLK occurs due to counting based upon the clock signal DCLK. When the data enabling signal DE is at the high level again, first counter 230*a* restarts counting and repeats the process of storing and resetting along with the changing level of the data enabling signal DE.

When first counter 230*a* stops counting, that is, when the data enabling signal DE is at the low level, second counter 231*a* starts counting. When the data enabling signal DE is at the high level, second counter 231*a* stops counting and stores a counted value into second register 231*b* which is then reset to zero. When the data enabling signal DE is at the low level again, the second counter 231*a* restarts counting and repeats the process of storing and resetting along with the changing level of the data enabling signal DE.

First comparator 232 reads and compares the values in first register 230*b* and second register 231*b*. If the value in second register 231*b* is smaller than the value in first register 230*b*, then first comparator 232 transfers and stores the value in second register 231*b* into third register 233. At this time the value in third register 233 represents the horizontal synchronization interval thb+thfp, and the value in third register 233 is particularly the number of times that the high level of the clock signal DCLK occurs due to counting based upon the clock signal DCLK. If the value in second register 231*b* is larger than the value in first register 230*b*, then first comparator 232 transfers and stores the value in second register 231*b* into fourth register 234. At this time the value in fourth register 234 represents the vertical synchronization interval tvb+tvfp, and the value in fourth register 234 is particularly the number of times that the high level of the clock signal DCLK occurs due to counting based upon the clock signal DCLK.

In a subsequent process, first comparator 232 monitors the number of times that the value in second register 231*b* is transferred and stored into fourth register 234, and when the value in second register 231*b* is transferred and stored into fourth register 234 for the second time, first comparator 232 transmits an indication signal to third counter 235*a*.

Third counter 235*a* receives a counting result from first counter 230*a* and performs counting based upon the horizontal display period thd, that is, counts the number of times that the high level of the data enabling signal DE occurs until reception of the indication signal transmitted from first comparator 232. At this time third counter 235*a* stops counting and stores a counted value into fifth register 235*b*, and then third counter 235*a* is reset to zero and restarts counting. At this time the value in fifth register 235*b* represents the vertical display period tvd, and the value in fifth register 235*b* is particularly the number of times that the high level of the data enabling signal DE occurs due to counting based upon the horizontal display period thd. A single high level of the data enabling signal DE can be represented by the number of times that a plurality of high levels of the clock signal DCLK occurs, so the value in the fifth register 235*b* can be equivalent to the number of times that the high level of the clock signal DCLK occurs.

First adder 236*a* reads and performs an addition operation on the values in first register 230*b* and third register 233 and stores a result of the addition operation into sixth register 236*b*. At this time, the value in sixth register 236*b* is the sum of the values in first register 230*b* and third register 233, thd+thb+thfp, and the value in sixth register 236*b* is the horizontal synchronization cycle th, and since the values in both first register 230*b* and third register 233 are obtained through counting based upon the clock signal DCLK, the value in sixth register 236*b* is particularly the number of times that the high level of the clock signal DCLK occurs.

Second adder 237*a* reads and performs an addition operation on the values in fourth register 234 and fifth register 235*b* and stores a result of the addition operation into seventh register 237*b*. At this time the value in seventh register 237*b* is the sum of the values in fourth register 234 and fifth register 235*b*, tvd+tvb+tvfp, and the value in seventh register 237*b* is the vertical synchronization cycle tv. Since the value in fourth register 234 is obtained through counting based upon the clock signal DCLK and the value in fifth register 235*b* can be equivalent to the number of times that the high level of the clock signal DCLK occurs, the value in seventh register 237*b* can also be equivalent to the number of times that the high level of the clock signal DCLK occurs.

Thus, the values of the six key timing parameters detected once by the timing detecting unit are obtained in the foregoing process. First array of comparators 238 reads first register 230*b*, sixth register 236*b*, third register 233, fourth register 234, seventh register 237*b* and fifth register 235*b* to obtain the six key timing parameters and compares the six key timing parameters with corresponding values stored in first array of registers 239 to determine whether the six key timing parameters are consistent respectively.

Specifically, first array of comparators 238 includes a multitude of comparators to perform the comparison process respectively, and first array of registers 239 includes a multitude of registers, the number of which corresponds to the number of comparators in first array of comparators 238. The number of comparators in first array of comparators 238 can be the same as the number of key timing parameters, which is six in this embodiment, or more than the number of key timing parameters so as to support more key timing parameters.

When the timing detecting unit detects the key timing parameters for the first time, apparently no value is stored in first array of registers 239, so comparison results of the respective comparators in first array of comparators 238 apparently also show inconsistency. At this time, first array of comparators 238 outputs the control signals to the timing controlling unit and stores the values read in first register 230*b*, sixth register 236*b*, third register 233, fourth register 234, seventh register 237*b* and fifth register 235*b* respectively into the corresponding registers in first array of registers 239 and outputs the six key timing parameters to the timing controlling unit through the corresponding registers in first array of registers 239.

In a subsequent process, if the comparison result of any comparator in first array of comparators 238 shows inconsistency, then first array of comparators 238 will output the control signals to the timing controlling unit and store new values read in first register 230*b*, sixth register 236*b*, third register 233, fourth register 234, seventh register 237*b* and fifth register 235*b* respectively into the corresponding registers in first array of registers 239 and output updated values of the six key timing parameters to the timing controlling unit through the corresponding registers in first array of registers 239. If the comparison results of all the comparators in first array of comparators 238 show consistency, then first array of comparators 238 will neither output any control signal to the timing controlling unit nor store any value into first array of registers 239.

Furthermore, a detection cycle for the key timing parameters shall be larger than three vertical synchronization cycles in order to ensure correct detection of the key timing parameters by the timing detecting unit. Correspondingly in another embodiment of the timing controller for a thin film transistor-liquid crystal display, first comparator 232 transmits a comparison starting signal to first array of comparators 238 when the value in second register 231*b* is transferred and stored in fourth register 234 for the fourth time, and first array of comparators 238 starts the foregoing process of reading the registers, comparing and storing into the register only after obtaining the comparison starting signal. Likewise when the comparison result of any of the six key timing parameters shows inconsistency, first array of comparators 238 outputs the control signals to the timing controlling unit, and first array of registers 239 outputs updated values of the six key timing parameters to the timing controlling unit. Also the timing detecting unit correspondingly starts a new cycle to detect the key timing parameters.

The above embodiments of the present invention are illustrative and not limiting. Various alternatives and equivalents are possible. Although, the foregoing description is made with reference to six key timing parameters that are detected by the timing controller, it is understood that the invention is not limited by the number of key timing parameters, which may be more or less than six key timing parameters. Correspondingly it is only necessary to modify the numbers of corresponding counters, registers, adders and other logic components in the timing detecting unit. Furthermore, although the foregoing description is made with a thin film transistor-liquid crystal display as an example, it is understood that the invention is not limited by the type of display. An analysis of other types of displays shows that timing control signals and image data are also signals required for other types of displays to display an image and the foregoing relevant horizontal and vertical timing parameters can also be regarded as basic timing parameters generally required for displaying an image. Thus the timing controller can also be applicable to other types of displays. Other additions, subtractions, or modifications are obvious in view of the present disclosure and are intended to fall within the scope of the appended claims.

What is claimed is:

1. A timing controller for a display, comprising:

a first unit configured to generate an image signal from a first input signal;

a second unit configured to generate a plurality of timing signals and a control signal from a plurality of second input signals, the control signal being generated after the plurality of timing signals are generated; and a third unit configured to generate a plurality of first signals from the plurality of timing signals after receipt of the control signal from the second unit, wherein the image signal and the plurality of first signals are configured to drive the display when the timing controller is connected to the display, wherein the plurality of timing signals comprise a horizontal display period, a horizontal synchronization cycle, a horizontal synchronization interval, a vertical display period, a vertical synchronization cycle and a vertical synchronization interval, the plurality of second input signals comprise at least an enabling signal and a clock signal, and the second unit comprises:

a fourth unit configured to generate a first count of the clock signal during a first level of the enabling signal, the first count representing the horizontal display period;

a fifth unit, connected with the fourth unit, configured to generate a second count of the clock signal during a second level of the enabling signal, the second level being different than the first level, the second count representing the horizontal synchronization interval when the second count is smaller than the first count;

a sixth unit, connected with the fourth unit, configured to generate a third count of the clock signal during the second level of the enabling signal, the third count representing the vertical synchronization interval when the third count is larger than the first count;

a seventh unit, connected with the fourth unit and the fifth unit, configured to sum the first count and the second count thereby representing the horizontal synchronization cycle;

an eighth unit, connected with the fourth unit and the sixth unit, configured to generate a fourth count of the clock signal during the first count for a period of time taken by the sixth unit to obtain the third count twice, the fourth count representing the vertical display period; and a ninth unit, connected with the eighth unit and the sixth unit, configured to sum the fourth count and the third count thereby representing the vertical synchronization cycle.

2. The timing controller for a display according to claim 1, wherein the timing controller is further configured to drive a first display including a first resolution or a second display including a second resolution without modifying an internal setting of the timing controller, the first resolution being different than the second resolution.

3. The timing controller for a display according to claim 1 further comprising a display configured to display an image according to the plurality of first signals and the image signal.

4. The timing controller for a display according to claim 1, wherein the first input comprises RGB input data and the image signal comprises RGB output data.

5. The timing controller for a display according to claim 1, wherein the plurality of first signals include a plurality of display timing control signals.

6. The timing controller for a display according to claim 1, wherein the second unit restarts the third unit when the plurality of timing signals are changed, and after being started, the third unit updates the plurality of first signals after obtaining an updated plurality of timing signals.

7. The timing controller for a display according to claim 1, wherein the timing controller is integrated in the display.

8. The timing controller for a display according to claim 1, wherein the horizontal synchronization cycle is equal to the sum of the horizontal display period and the horizontal synchronization interval, and the vertical synchronization cycle is equal to the sum of the vertical display period and the vertical synchronization interval.

9. The timing controller for a display according to claim 1, wherein an only timing constraint of the plurality of second input signals consists of the vertical synchronization interval being larger than the horizontal synchronization cycle and further consists of the horizontal synchronization cycle being larger than the horizontal synchronization interval.

10. The timing controller for a display according to claim 1, wherein the display is a thin film transistor-liquid crystal display and the plurality of first signals comprise a source control signal and a gate control signal.

11. The timing controller for a display according to claim 10, wherein the second unit restarts the third unit when the plurality of timing signals are changed, and after being started, the third unit updates the source control signal and the gate control signal after obtaining the updated plurality of timing signals.

12. A method for controlling timing signals to a display by a timing controller, the method comprising:

generating an image signal from a first input signal;

generating a plurality of timing signals from a plurality of second input signals;

generating a control signal from the plurality of second input signals after the plurality of timing signals are generated;

generating a plurality of first signals from the plurality of timing signals after receipt of the control signal; and driving the display by the timing controller when the image signal and the plurality of first signals are connected to the display, wherein the plurality of timing signals comprise a horizontal display period, a horizontal synchronization cycle, a horizontal synchronization interval, a vertical display period, a vertical synchronization cycle and a vertical synchronization interval, the plurality of second input signals comprise at least an enabling signal and a clock signal, and generating the plurality of timing signals from the plurality of second input signals comprises:

generating a first count of the clock signal during a first level of the enabling signal, the first count representing the horizontal display period;

generating a second count of the clock signal during a second level of the enabling signal, the second level being different than the first level, the second count representing the horizontal synchronization interval when the second count is smaller than the first count;

generating a third count of the clock signal during the second level of the enabling signal, the third count representing the vertical synchronization interval when the third count is larger than the first count;

summing the first count and the second count thereby representing the horizontal synchronization cycle;

generating a fourth count of the clock signal during the first count for a period of time taken by the sixth unit to obtain the third count twice, the fourth count representing the vertical display period; and summing the fourth count and the third count thereby representing the vertical synchronization cycle.

13. The method of claim 12, wherein driving comprises driving a first display including a first resolution or a second display including a second resolution without modifying an internal setting of the timing controller, the first resolution being different than the second resolution.

14. The method of claim 12, wherein the plurality of timing signals comprise a horizontal display period, a horizontal synchronization cycle, a horizontal synchronization interval, a vertical display period, a vertical synchronization cycle and a vertical synchronization interval.

15. The method of claim 14, wherein an only timing constraint of the plurality of second input signals consists of the vertical synchronization interval being larger than the horizontal synchronization cycle and further consists of the horizontal synchronization cycle being larger than the horizontal synchronization interval.

* * * * *